US006721984B1

(12) United States Patent
Harrison

(10) Patent No.: US 6,721,984 B1
(45) **Date of Patent: *Apr. 20, 2004**

(54) MULTIFUNCTION TOOL WITH REPLACEABLE IMPLEMENTS

(75) Inventor: Dan W. Harrison, Brownsboro, TX (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/331,566

(22) Filed: Dec. 30, 2002

Related U.S. Application Data

(63) Continuation of application No. 09/837,095, filed on Apr. 18, 2001, now Pat. No. 6,523,203, which is a continuation of application No. 09/540,399, filed on Mar. 30, 2000, now abandoned, which is a continuation-in-part of application No. 09/148,530, filed on Sep. 4, 1998, now abandoned.

(51) Int. Cl.[7] ..... B25B 7/22
(52) U.S. Cl. ..... 7/128; 7/129; 7/169
(58) Field of Search ..... 7/128, 129, 169, 7/158, 125

(56) References Cited

U.S. PATENT DOCUMENTS

| | | | |
|---|---|---|---|
| 4,238,862 A | 12/1980 | Leatherman | |
| 4,744,272 A | 5/1988 | Leatherman | |
| 4,794,692 A | 1/1989 | Wang | |
| 4,920,593 A | 5/1990 | Finn | |
| 5,062,173 A | 11/1991 | Collins et al. | |
| 5,142,721 A | 9/1992 | Sessions et al. | |
| 5,212,844 A | 5/1993 | Sessions et al. | |
| 5,245,721 A | 9/1993 | Lowe et al. | |
| 5,267,366 A | 12/1993 | Frazer | |
| 5,689,886 A | 11/1997 | Yeh | |
| 5,735,005 A | 4/1998 | Wang | |
| 5,781,950 A | 7/1998 | Swinden et al. | |
| 6,009,582 A | 1/2000 | Harrison et al. | |
| 6,088,860 A | 7/2000 | Poehlmann et al. | |
| 6,145,144 A | 11/2000 | Poehlmann et al. | |
| 6,357,068 B1 | 3/2002 | Seber et al. | |
| 6,523,203 B2 * | 2/2003 | Harrison | 7/128 |

FOREIGN PATENT DOCUMENTS

EP 1 023 972 A2 8/2000

OTHER PUBLICATIONS

Knife World, Nov. 1993, vol. 19, No. 11: pp. 24–26.

* cited by examiner

*Primary Examiner*—Lee D. Wilson
(74) *Attorney, Agent, or Firm*—Foley & Lardner

(57) ABSTRACT

A multifunction tool includes a pair of handles, each handle having two side walls and a plate connecting the two side walls. A pair of jaws is coupled to the handles, each jaw having at least one pin extending therefrom. A slot is disposed in at least one side wall, the slot configured to receive the pin, whereby the jaws are slidably coupled to the handles such that the jaws have a retracted position and an extended position. At least one ancillary tool is coupled to one of the handles.

22 Claims, 22 Drawing Sheets

MULTIFUNCTION TOOL WITH REPLACEABLE IMPLEMENTS

This is a continuation of application Ser. No. 09/837,095, filed Apr. 18, 2001, now U.S. Pat. No. 6,523,203, which is a continuation of application Ser. No. 09/540,399, filed Mar. 30, 2000, now abandoned, which is a continuation-in-part of application Ser. No. 09/148,530 filed Sep. 4, 1998, now abandoned, all of which are incorporated herein by reference in their entirety.

FIELD OF THE INVENTION

The instant invention relates to multiple function or combination tools based about replaceable retractable pliers and specifically designed to occupy minimum space when out of use while allowing for replaceable implements.

BACKGROUND OF THE INVENTION

Multiple function or combination tools are well know in the art. The best known tool is the so-called Swiss Army Knife which contains a variety of instruments, each having its own purpose. In the Swiss Army Knife the separate instruments are generally various forms of blade devices (knives, screwdrivers, scissors, saws, cork screws, and the like) which fold about a central axis in the case. In addition, there are some removable tools contained within the case such as a toothpick, a set of tweezers, or a small screwdriver held within a cork screw.

One particular model of the Swiss Army Knife includes a set of folding pliers which uses the case as the first handle and a thin metal blade like device as the second handle. The pliers are somewhat difficult to use and the operator should hold the knife case (first) handle in the palm of the hand while pressing on the blade like second handle with the thumb of the same hand. It is a difficult tool to use and one cannot exert a great amount of pressure on an object being gripped by the pliers.

Leatherman (U.S. Pat. Nos. 4,238,862 and 4,744,272) and Collins (U.S. Pat. No. 5,062,173) disclosed a folding combination tool based around a set of pliers which are manipulated in the standard fashion by gripping the opposing handles between the heel of the thumb and the fingers of the hand. The handles of these devices contain blade-like tools such as knives, various screwdrivers, scissors, saws, cork screws, and the like. In the case of the Leatherman disclosures, the blade-like tools fold outward from the reverse end of the handles of the associated set of pliers. The greatest drawback of the Leatherman tool is that the hand closes around the open "U" of the handles; thus, when one exerts a large force the open "U" tends to cut into the skin. Collins improved the Leatherman Tool by rotating the "U" by ninety-degrees; thus, one grips a flat surface (namely the outside of one of the sidewalls of the "U") when squeezing on the handles of the pliers.

Sessions et al. (U.S. Pat. Nos. 5,142,721, filed on Mar. 8, 1991 and 5,212,844, filed on Jul. 28, 1992) disclose a device that uses two "U" shaped handles with the set of pliers being slidingly and retractably contained within the "U" handles. The pliers are locked in the open position or the closed position by a tang operating within a slot in the channel section of the "U" shaped handle.

In certain conventional tools, if the object being gripped by the pliers slips out of the jaws of the pliers, the handles snap together and may pinch the palm of the user. There is a need for an improvement to such a configuration.

Current multifunction tool manufacturers provide different types of jaws within their tools; however, the jaws are not readily replaceable by the end-user. That is, if the end user wanted a square set of cross-jaws rather than a needle-nosed set of cross jaws, that same end-user would purchase a second given tool with a set of square cross-jaws. In a similar manner, if the end-user wanted a set of tin shears, then the end-user must purchase a separate tool.

Thus there is a need for a combination tool which will not pinch the palm of the user, if the jaws of the pliers slip off of an object while having replaceable cross-jaws that can meet the specific needs of the user at a given particular time.

SUMMARY OF THE INVENTION

The present invention utilizes two "U-shaped" handles, or channel-shaped handles, slidingly attached to the modified arms of a set of pliers. In the extended (use mode) position, the channel-shaped handles form a natural set of handles for the pliers. In the retracted (stored/safety mode), the pliers are retained within the channel-shaped handles. At the end opposite to the pliers, are found a series of ancillary blade-type tools, which rotate out of the U-shaped handles similar to a pocket knife. The ancillary tools include various sized knives, screwdrivers (flat, Philips, Torax, etc.), scissors, awls, corkscrews, and the like, which may be set up in groups to meet the specific need of the user.

Like a pocket knife, the blade-like ancillary tools incorporate spring retention which allow only one blade at a time to be placed in use and which will snap-lock the chosen blade open or closed. Unlike a pocket knife, the selected blade-device may only be placed in use if the U-shaped handle is slid back away from the associated arm of the pliers. Once the blade-device is chosen and moved to the open (in use) position, the U-shaped handle is moved back over the head of the pliers. This action locks the ancillary blade open so that it cannot inadvertently close on the user.

The pliers slide within the U-shaped handles in such a manner so the channel section (U-section) of the U-channel is to the outside ensuring that the hand will grip a smooth surface. Each sidewall of the U-channel has a slot which runs more or less in the center of the sidewall from the end nearest the pliers to about mid-way along the channel. The pliers have two tangs on each side of their arms which slide within the slot (total of four per arm). One set of the tangs, in the arm, is spring loaded so that they may act as a lock which holds the pliers in the open position; whereas, the second set of tangs is also spring loaded. The second set of tangs do not act as a lock, but act along with the locking tangs to hold the jaws within the channel until the user wishes to remove the jaws from the handles. (There is an embodiment in which the pliers can be locked in the retracted position.) To open the tool, the user pulls the two handles apart, holds one set of handles in one hand, and pulls the head out of the channel with the other hand. The user would repeat the action with the other handle. Alternately, the user pulls the handles apart and shakes, or flips, the tool outward while holding one handle. This action imparts a force to the head which causes the head to extend from the handle. The user then flips the tool in the other direction and the remaining handle will move away from the head, leaving the complete head in an extended position. Thus, the pliers are ready for use and are locked in place. The lock is deactivated by squeezing on the locking tangs with the thumb and forefinger while sliding the handle back away from the jaws of the pliers. Similar actions would be utilized if the user wishes to extend one of the ancillary blade-type devices.

As in the earlier Harrison tool, the slot does not lie completely along the center-line of the channel. sidewalls.

There is a slight angle (or offset) between the center line of the slot at the end nearest the head of the pliers. This slight angle assures, that when the pliers are in their extended (in use mode), there will always be a gap between the handles whenever the jaws of the pliers are tightly closed against each other. This means that the user will not have one's palm pinched, between the handles, if the jaws slip off of an object while in use.

The jaws are replaceable by individually squeezing on the two sets of tangs located within 20 the slot in each handle and pulling the jaws from within the handle. A second set of jaws would then be placed in each handle and the tool returned to service.

BRIEF DESCRIPTION OF THE DRAWINGS

Figure One is an illustration of a first embodiment of the tool with the pliers in their extended (in use) position—jaws and handles open and with a typical selection of ancillary tools exposed for viewing.

Figure Two is a schematic top view of the embodiment of Figure One.

Figure Three is a schematic side view of the embodiment of Figure One.

Figure Four-A is a top view of the pliers head of the embodiment of Figure One illustrating the guide and latch tangs.

Figure Four-B is a top view of the pliers head of the embodiment of Figure One illustrating the rear spring loaded guide and latch tangs.

Figure Five is a side view of the pliers head of Figure Four.

Figure Six is a schematic side view of the embodiment of Figure One showing the pliers head extended with the jaws tightly against each other and illustrating the gap between the handles.

Figure Seven is a schematic top view of a second embodiment of the tool which allows for ancillary long blades to be stored within a handle cover.

Figure Eight is a side view of the embodiment of Figure Seven.

Figure Nine is a schematic top view of a third embodiment of the tool which uses a separate locking tang acting within the channel section of the U-shaped handle.

Figure Ten is a schematic side view of the embodiment of Figure Nine.

Figure Eleven is a schematic side view of the embodiment of Figure Nine showing the pliers head extended with the jaws tightly against each other and illustrating the gap between the handles.

Figure Twelve is a top view of the pliers head of the embodiment of Figure Nine illustrating the guide and latching tangs.

Figure Thirteen is a side view of the pliers head of Figure Twelve.

Figure Fourteen is a illustration of the latching tang used in embodiments one, two and four.

Figure Fifteen is an inside view of the U-shaped handles showing the arrangement of the blade springs and blades for the embodiment of Figure One.

Figure Sixteen is a schematic illustration of the blade locking spring arrangement.

Figure Seventeen is a schematic side view of an alternate arrangement (fourth embodiment) for the pliers head of the embodiment of Figure One illustrating the guide and latching tangs.

Figure Eighteen is a top view of the embodiment of Figure Seventeen.

Figure Nineteen is a side view of the pliers head of Figure Seventeen.

Figure Twenty shows the first embodiment with the retractable pliers frilly extended and illustrates the best mode for the length of the slot, the position of the tangs, and the relative angle within the slot.

Figure Twenty-one shows the first embodiment with the retractable pliers fully retracted and illustrates the best mode for the length of the slot, the position of the tangs, and the relative angle within the slot.

DESCRIPTION OF THE PREFERRED EMBODIMENTS

Figure 1:
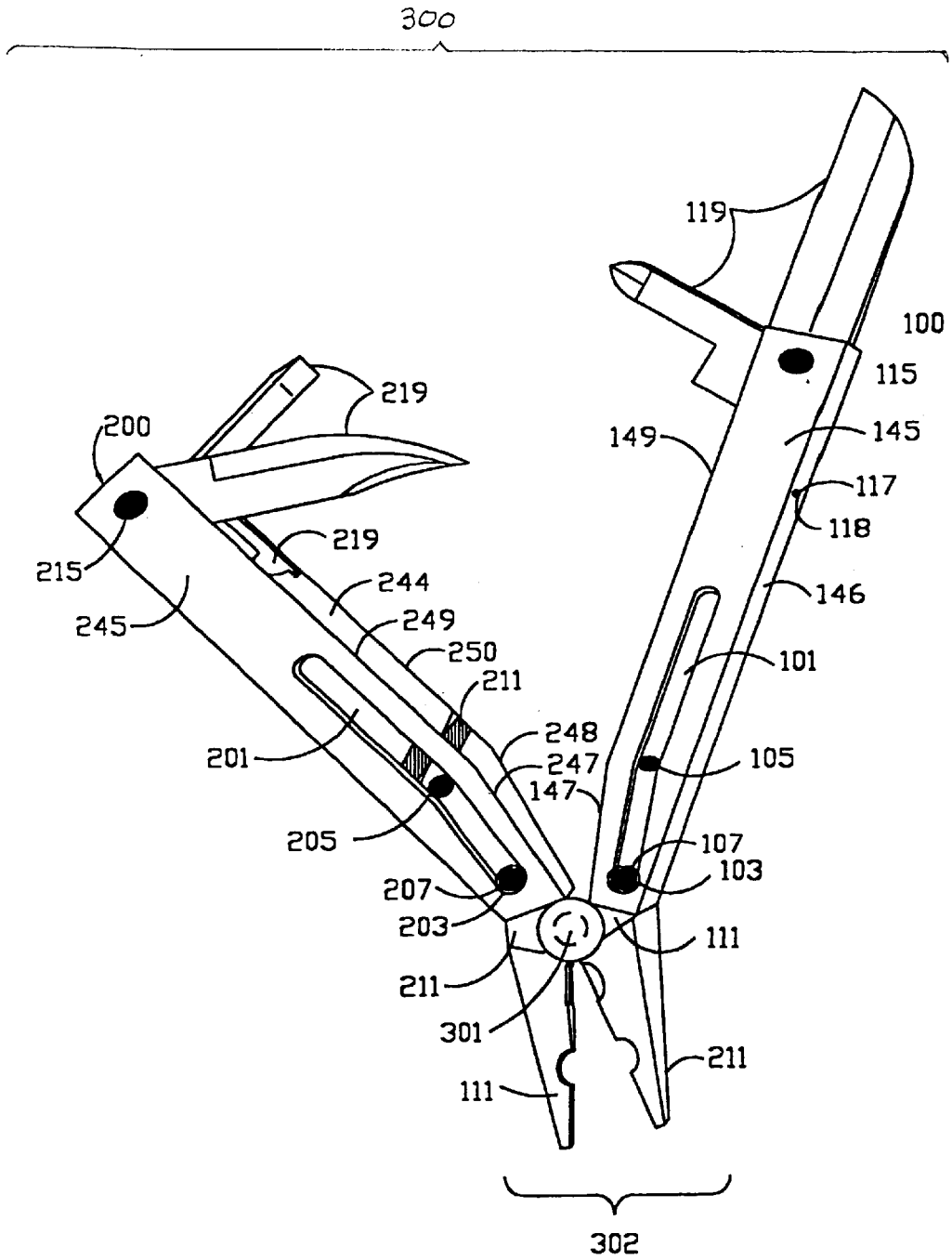
Figure 2:
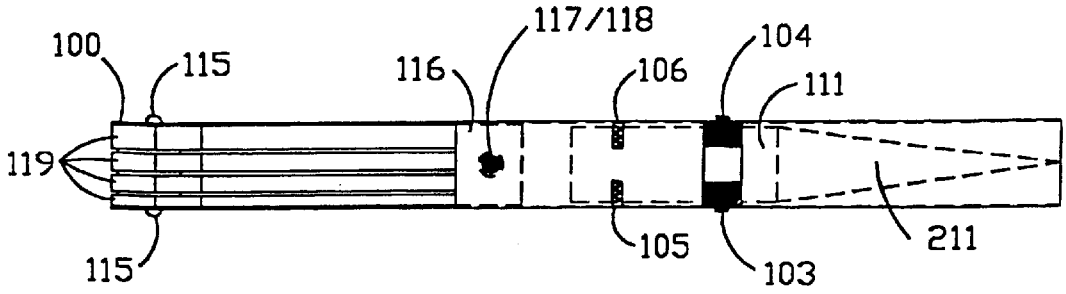
Figure 3:
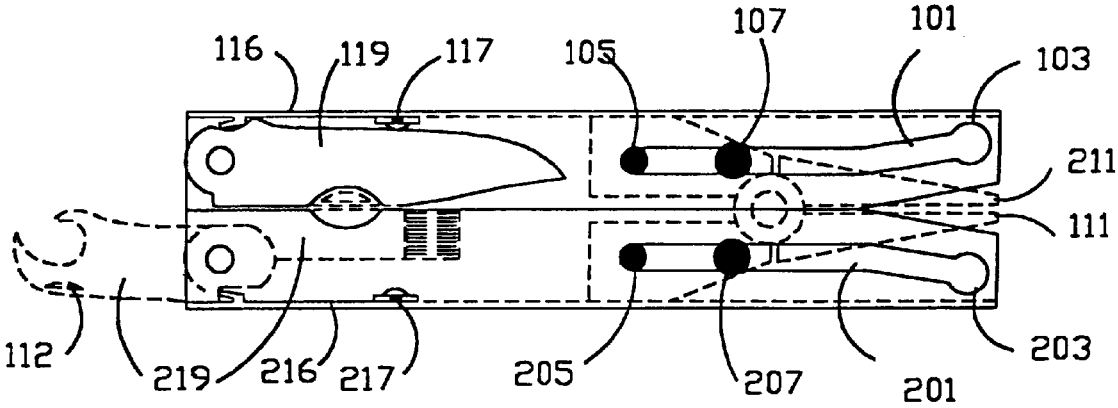
Figure 4A:
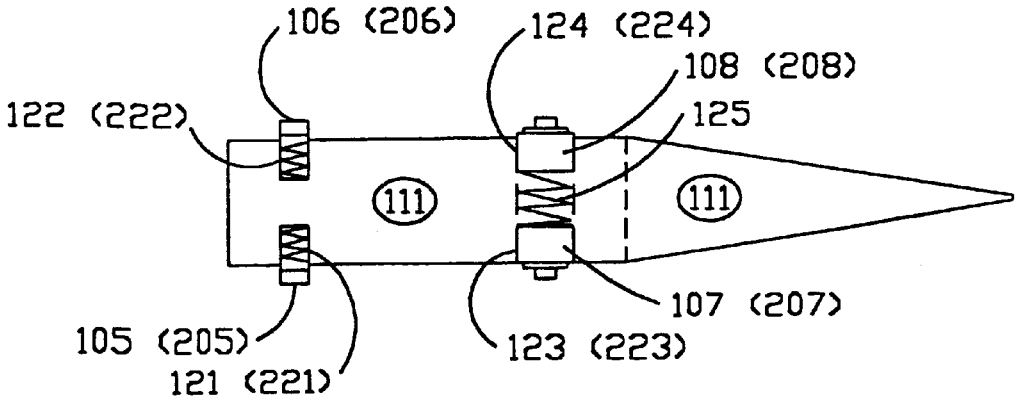
Figure 4B:
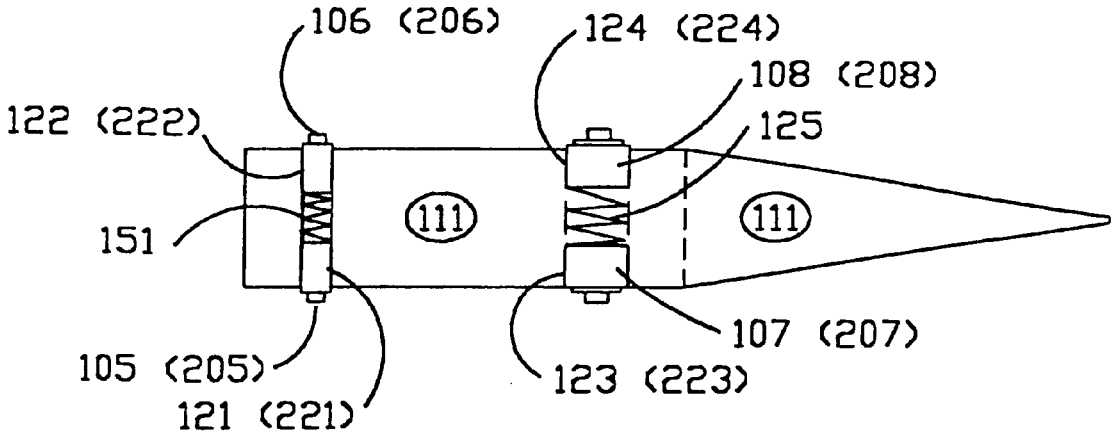
Figure 5:
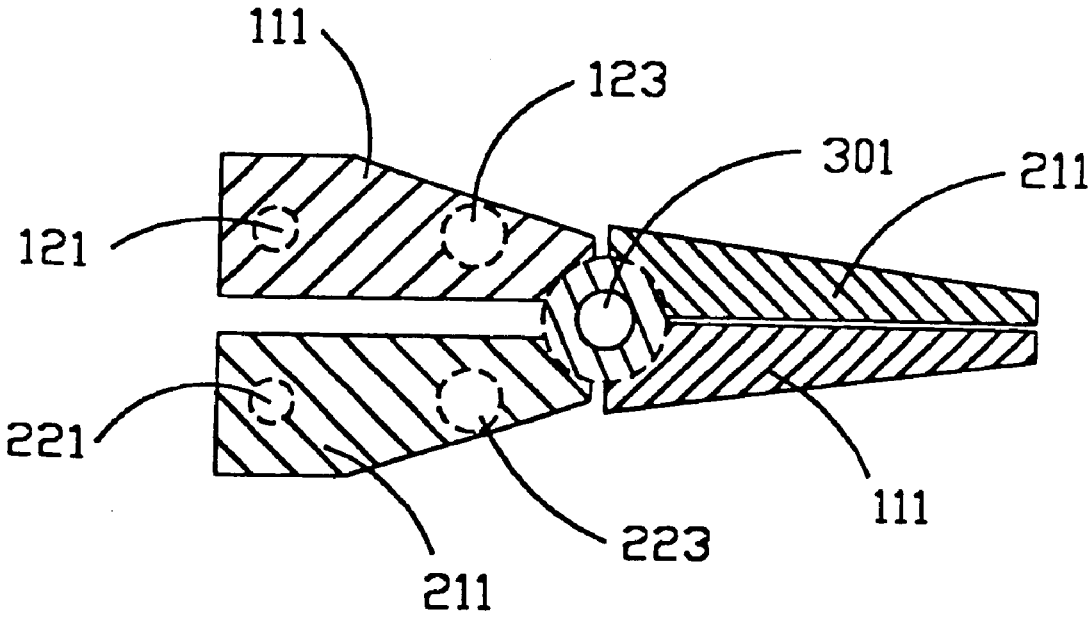
Figure 6:
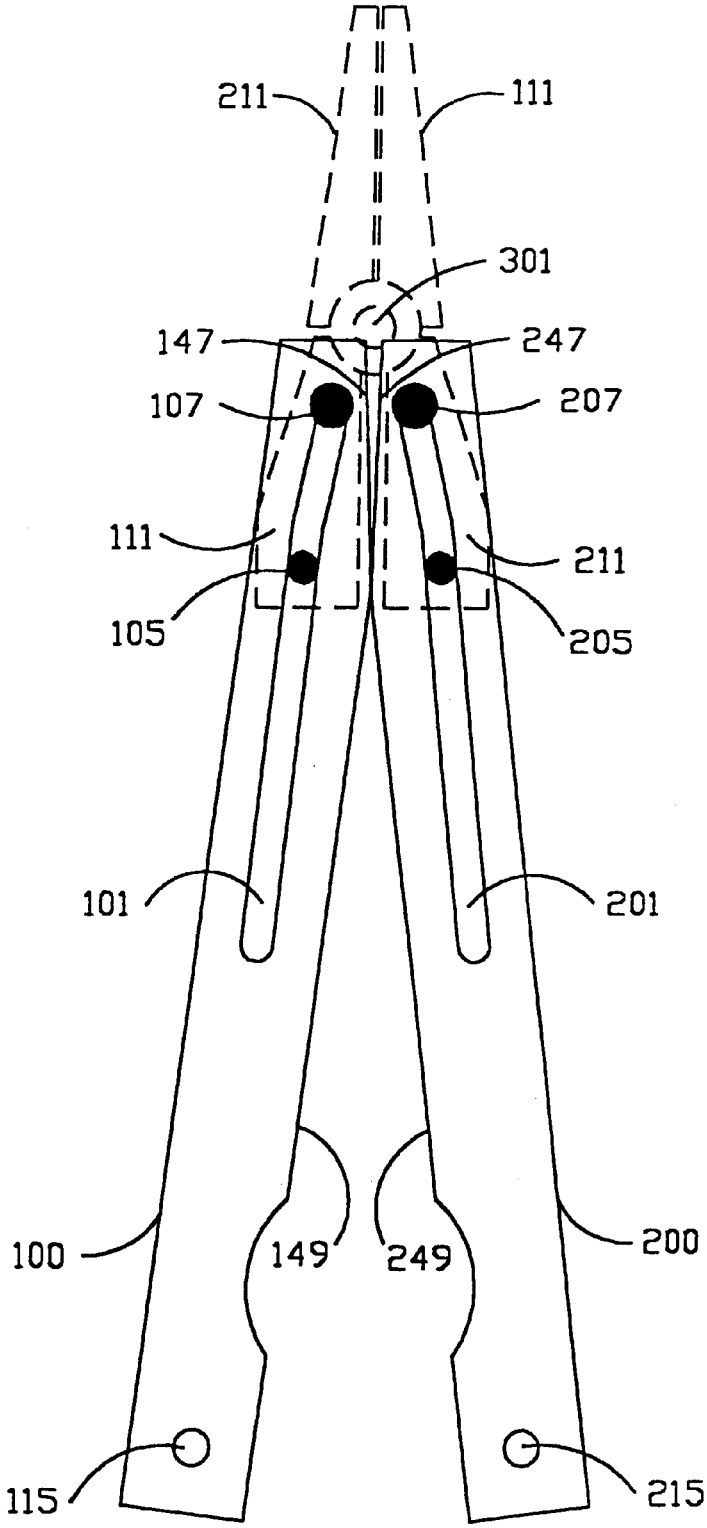

The preferred (first) embodiment is shown in FIGS. 1 through 6. The instant invention is shown generally as 300 and includes a set of pliers having a pair of jaws, 111 and 211, and a pair of associated handles, 100 and 200. In addition, each handle contains a series of associated ancillary blade-like tools generally shown as 119 and 219. The pliers, 302, as will be explained, are designed to retract within its handles, 100 and 200, when the handles are closed. Conversely, the pliers, 302, are designed to take a fully extended position when in use. The active (extended) position of the pliers is illustrated in FIGS. 1 and 6, and the stored (retracted) position is illustrated in FIGS. 2 and 3.

In the extended position, the pliers (namely the two jaws and their associated handles) are capable of standard pivotal motion with respect to each other about the common pivot point, 301. In the retracted position the handles are prevented from opening due to interaction between the pliers and the handles, as will be explained. The ancillary blade-like tools, 119 and 219, are pivotally mounted at the end of the handles away from pliers (the distal end).

Thus, it can be seen that the multifunction tool of the instant invention comprises of a pair of similar members. Each member further having a basic handle, 100 or 200; a set of blade-like ancillary tools, 119 or 219; and a jaw, 111 or 211, in turn forming a pair of pliers, 302.

Because the instant invention involves a pair of members, it is only necessary to describe one of the members and its associated items. The only difference between one member and the other member would be found in the choice of the ancillary blade-like tools enclosed within its handle. The user certainly would like a choice of different blade ancillaries not two sets of similar tools. The blade-like ancillary tools are not unusual: the fact that the instant invention allows the use of pocket knife retaining springs is unusual in the art. These springs can be used because the invention uses sidewall slots to retain the pliers head. The sidewall slots in turn keep the inside portion of the handle clear of obstructions at the distal end and within the actual U-channel allowing the use of a spring.

The two handles, 100 and 200, are formed in the shape of U-channel comprising three parts: sidewall, 145 or 245, sidewall 144 (not shown) or 244, which are joined together by plate (the actual U-channel section of the U), 146 or 246, depending on the respective first or second handle. The plate, 146 or 246 is the U-shaped section or channel section of the overall U-channel.

Turn now to the second handle 200, which is identical, except for ancillary tools, 219, to the first handle 100, (containing ancillary tools 119) as shown in FIG. 1. It can be seen that the U-shaped handle starts with edges 249 and 247;

runs with the sidewall, 245; runs with the plate, 246; runs with the other sidewall, 244; and terminates with edges 250 and 248. Edges 249 and 247 are Continuous with respect to each but have a given angular relationship to each other. A similar angular relationship exists between edges 248 and 250. The angular relationship between these edges is better illustrated in FIG. 6 which shows that edges 147 and 247 are essentially parallel (and almost touching) whenever the jaws of the pliers are tightly closed (edges 148 and 248 are not shown). The angular relationship is chosen so that edges 149 and 249 (and not shown edges 150 and 250) cannot bite into the operator's palm whenever the pliers are tightly closed. I.e., if and when the pliers slip off of an object!

Each of the two sides of the handle contains a slot 201 (and not shown 202) located at approximately the mid-point of the sidewall and which runs parallel to edge 249 turning slightly and continuing to run parallel to edge 247. The corresponding slot, 202 not shown in the figure, similarly runs parallel to edges 250 and 247. Thus, the two slots are diametrically opposed and parallel to each such that a rod, or similar object, can move along and within the slots from one end of the slot to the other while remaining parallel to the plate (channel section), 246.

Now refer to FIGS. 1 through 6 and consider only the second handle, 200, because the fist handle is identical in the action and items to be described. The handle contains a slidingly, or retractably, received pliers jaw, 211. The jaw, 211, is retractably held within the handles by tangs (or pins) 205 and 203 running in slot 201 contained with sidewall 245; likewise a second set of tangs, 206 and 204 running within slot 202 (not shown) contained within sidewall 244. These load bearing tangs serve as guide tangs or as combination guide/locking tangs depending on the pair. The tangs pair as 105 and 106 and as 103 and 104. (see FIG. 2) The rear tangs (105 and 106) serve as load bearing guide tangs (or pins) and are screwed into apertures 221 and 222 respectively within the arms of the pliers jaw 211, if the jaws are to remain permanently within the handles. It would be possible to use spring loaded tangs similar to 303 (see FIG. 14) where the lips 131 and 132 are thinner and serve only as a bearing surface. This choice would be a manufacturing choice and makes no difference to the operation of the instant invention, if the jaws are to remain permanently within the handles. If this choice is made apertures 221 and 222 should be in communication with each other with a spring, 151 or 251, located between the two tangs. (See FIG. 4B.) On the other hand, if the jaws are to be replaceable by the user, then spring loaded tangs must be employed as shown in FIG. 4B.

No matter which embodiment is used, each jaw has a working surface or area which can grip or cut wire depending on the function required located in front of the common pivot exactly similar to a standard pair of pliers. In a similar manner each jaw has an arm, located behind the common pivot in which the tangs and tangs apertures are disposed.

Figure 14:
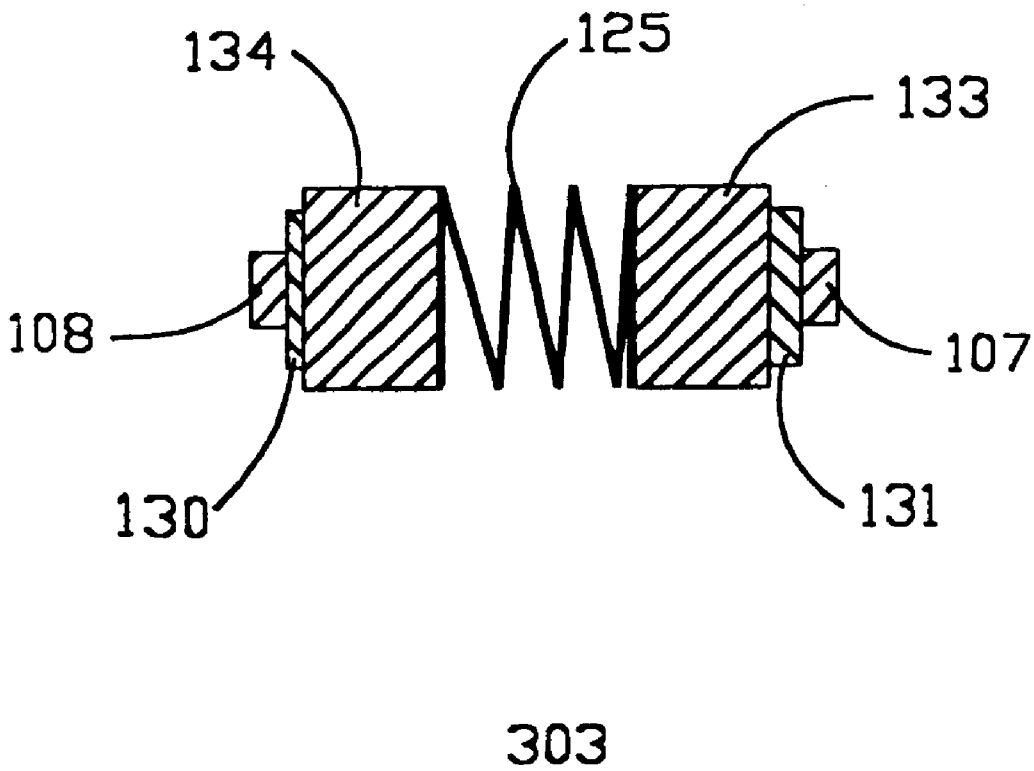

The front set of tangs (103 and 104) serve both as load bearing guide tangs and as locking tangs whenever the pliers head is in the extended position. The front set of locking tangs is actually a single assembly, 303, as shown in FIG. 14 and fits in aperture 223/224 in the pliers jaw, 211. These two apertures are in communication with each other. The assembly is retained by the sidewalls and within the slot whenever the jaw is placed within its respective handle.

Each of the tangs of the front pair consists of a guide portion, 107 and 108, which runs within its respective slot 201 or 202 and lock lips, 130 and 131, each formed within their respective lock lip/guide tang assembly 134 or 133. The two assemblies are separated by spring 125 forming the overall assembly 303 Whenever the pliers head travels to the "extended" end of the slot, lock lips 130 and 131, pop into their respective locking apertures 104 and 103 located at the front (extended) end of slots 201 and 202. (Remember that slot 202 is not shown, but is identical to slot 201 and is found in sidewall 244.) Thus, the pliers head is held in the extended position by assembly 303 which is common to both sides of the pliers head. (Note, it is possible to modify the concept to use only one such assembly within one of the two handles and such a concept is within the realm of the instant invention as a further embodiment. In fact, it would be possible to use guide/latching tangs assemblies as both front and rear tangs while providing only one latching aperture in the respective slot; thus, saving manufacturing expense. Such a choice is envisioned and forms a part of the instant invention.)

In the case of the replaceable jaws, all tangs are spring loaded and, although not completely necessary, have a retention means within the jaws to prevent the tangs from springing away from their aperture. (For example the side of the aperture may be crimped after the tangs are installed within its respective aperture.)

Figure 15:
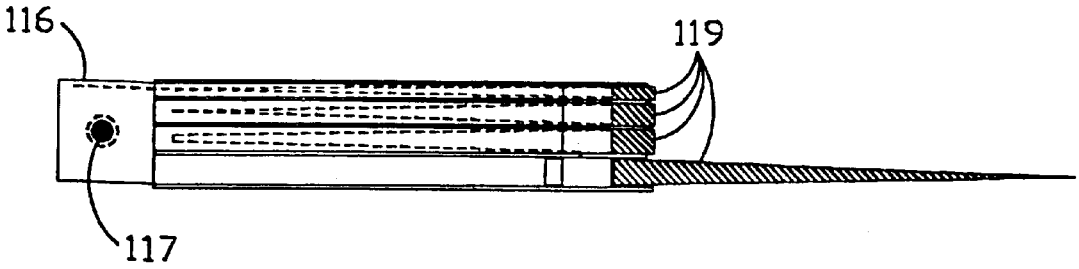
Figure 16:
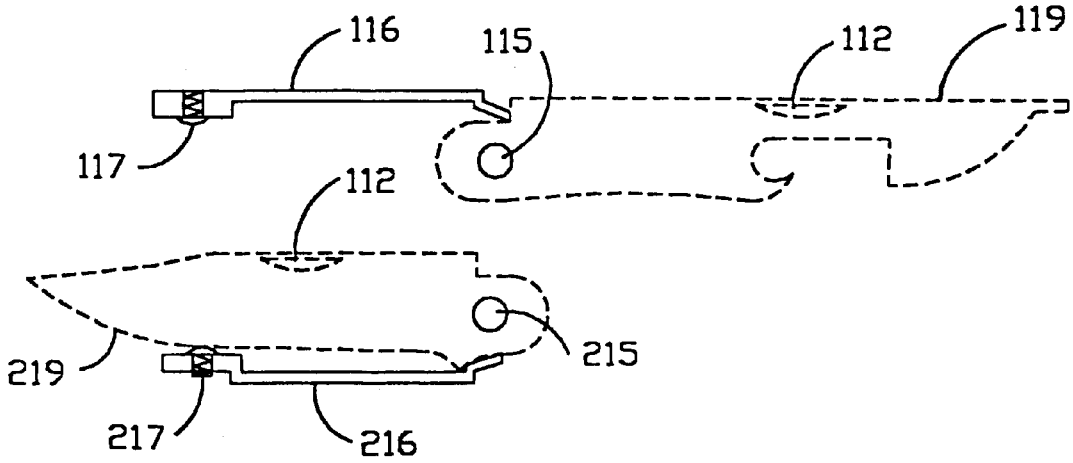

The distal ends of the handles (end opposite the pliers) contains a series of blade-like ancillary tools, 119 and 219 such as screwdrivers (flat, Torax, Philips, and the like), can openers, corkscrews, scissors, and etc. Unlike the prior art and because of the unique shape of the handles, each blade may be individually sprung like a standard pocket knife. Thus, the operator (user) may select one blade at a time and withdraw same without all of the blades pulling out at the same time. A standard finger nail slot, 112, would be cut into each blade as seen as in FIG. 2. The individual springs are cut from a single piece of spring steel, 116, (see FIGS. 15 and 16) and held in place within the inside of the respective handle by attachment 117 which can be a screw, a rivet or similar device.

Figure 20:
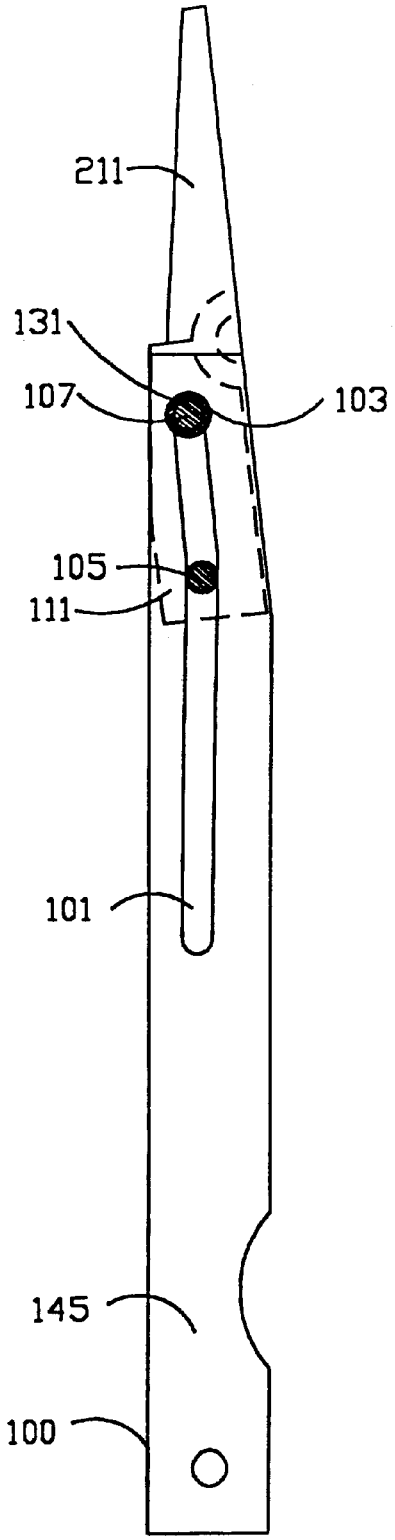

The use of the tool is quite simple. When the tool is stored (pliers head retracted), the tool appears very much like FIG. 3, except that no ancillary blades are extended. To extend the pliers head, the user (operator) simply holds one of the handles tightly between the fingers and the base of the thumb of one hand and flips the hand outwards. This action imparts momentum to the pliers head causing it to move forward out of the handle (held in the hand) while taking with it the other handle. The user then flips the wrist the in other direction which imparts momentum to the remaining handle which flies away from the pliers head leaving both handles extended away from the pliers head and ready for use. Alternately, the user can use the other hand to physically open the two handles and slide the respective head out from its handle. The user operates the extended pliers by griping the handles. In turn the handles transfer operating force to the pliers via the load bearing tangs and the portion of the pliers arm that is next to the inside of the plate (U-portion of the handles). This is illustrated in FIG. 20.

To close the tool, the user must push on each of the forward locking tangs, 107/108 and 207/208 between the thumb and forefinger to move the lock lips out of their associated locking aperture in the Slot, 103/203 and 104/204 (not shown). At the same time, the pliers head is pushed by the other hand so that it retracts into the handles.

Figure 10:
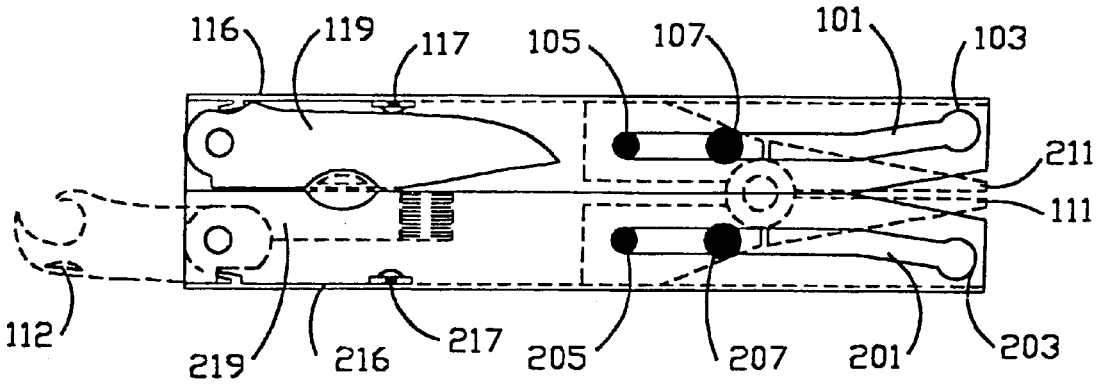
Figure 11:
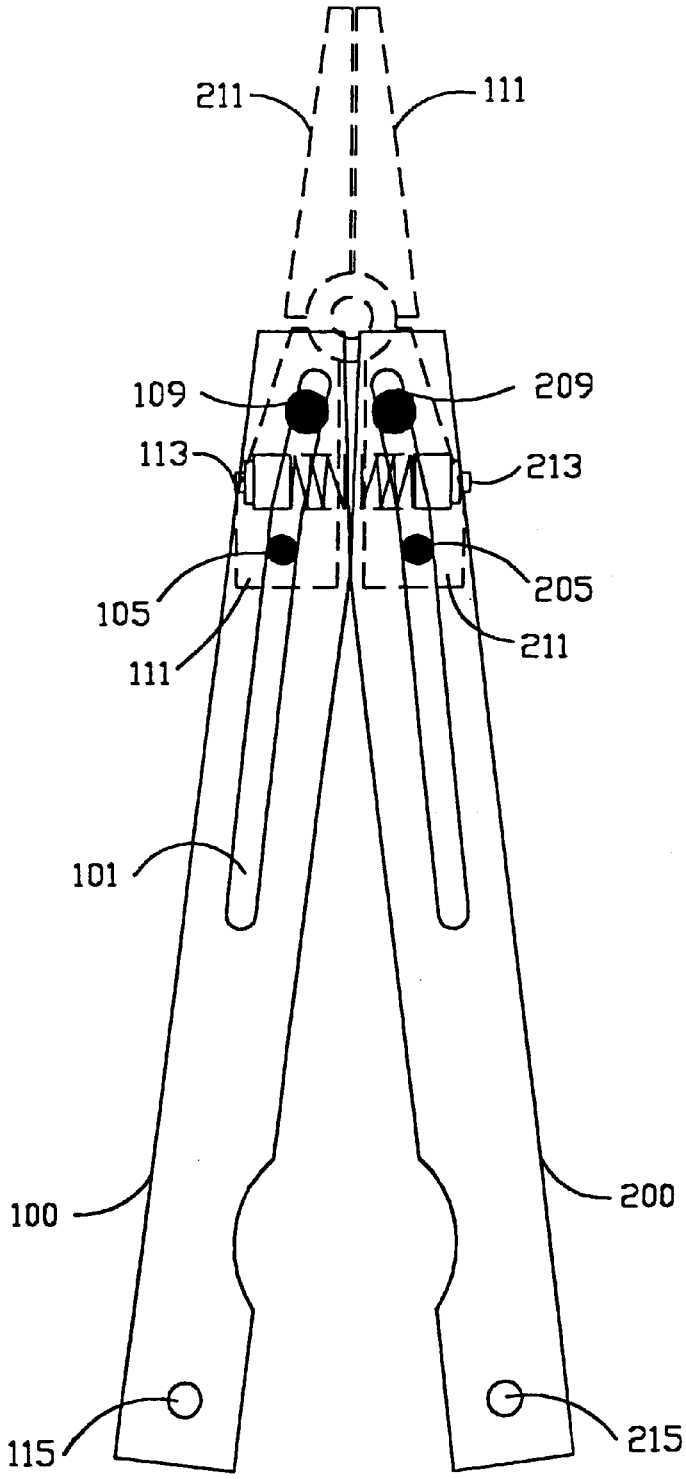
Figure 12:
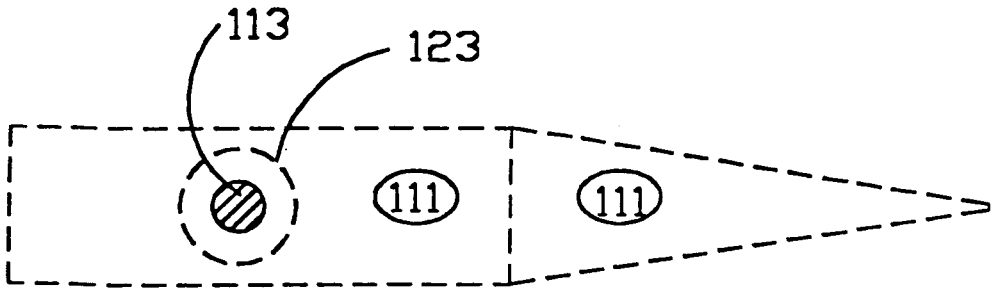
Figure 13:
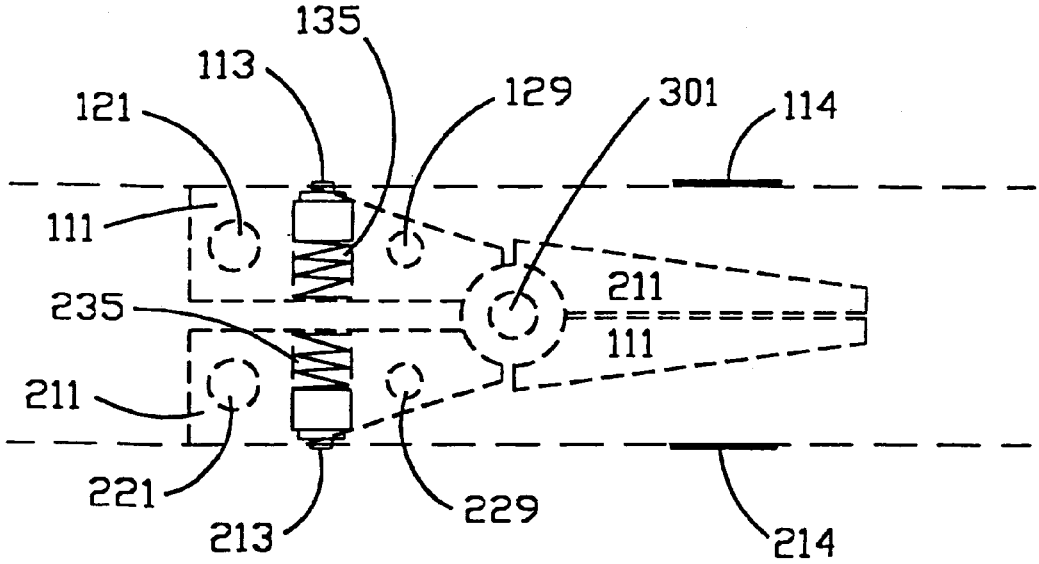
Figure 17:
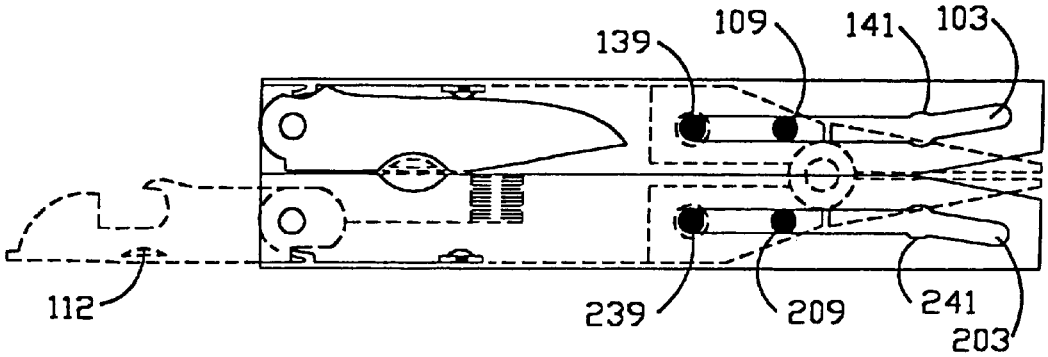

Close observation of FIG. 3 will show that an ancillary blade cannot be withdrawn from its respective handle unless the tool is open. In a similar manner, if a blade is extended, it cannot close unless the tool is open. This point is clearly illustrated by the extended ancillary blade, 219 in FIG. 3. (And for that matter in the alternate embodiments shown in FIGS. 10 and 17.) This is a clear safety feature in the instant invention, in that it stops accidental closure of an ancillary blade while it is in use. Additional accidental closure is provided by the locking spring, 116. Thus, to use an ancillary blade the tool handle must first be opened and then closed. To open a long ancillary blade, both sides of the tool must be opened. In the case of a short ancillary blade, only the handle associated with the blade need be opened.

Figure 21:
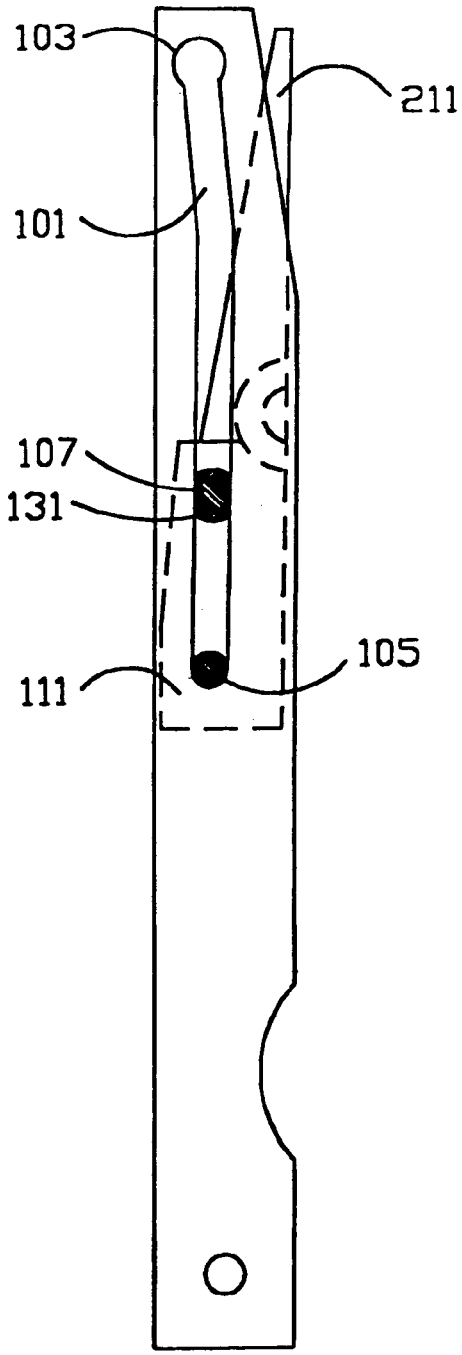

A unique feature of the tool is its ability to remain closed while an ancillary tool is being used. In fact, this ability will serve to keep the tool closed until the user wishes to use the pliers by activating them through the previously described "hand-flips" or manual extension. The feature is based on the angle of the slot, the back plain of the modified pliers handle, and the position of the tangs. FIGS. 20 and 21 show how the feature operates. In the extended (in use) position tangs 105 and 107 (plus the not shown tangs) are frilly forward within the angled portion of the slot with 107/131 and locked in place at 103. (This mode has previously been described.) Note how the back of the jaw, 111, is firmly against the inside of the channel plate, 146 (not shown). The extension of the opposite pliers jaw, 211, lies parallel to the angle portion of the slot and parallel to edge 147 of the sidewall (see FIG. 1).

Now see FIG. 21, which shows the pliers head retracted into the handle. Tangs 105 arid 107 move to the other end of the slot. From this drawing it is possible to see how the relative slot lengths come about. The angled portion of the slot (the section which is at an angle to the plate of the handle (back of the handle) must ONLY be as long as the distance between the tangs. The slot must extend into the locking aperture, 103, so that, when the jaw is extended, the back of the modified arm lies firmly against the inside of the plate (back of the handle), as illustrated in the drawing. Note that the change in angle begins at the point at which tang 105 lies whenever the pliers are extended. The section of the slot which lies parallel to edge 149 (see FIG. 1) and parallel to the plate (back of the handle) begins where tang 105 would lie whenever the tool is extended and ends so that tang 105 is against the end of the slot whenever the tool is fully within the handles (stored). It should be apparent that this length of slot will be a function of the length of the jaws and will most likely be longer than the angled section of the slot.

Note that when the tool is open, the handles pivot about the pliers common pivot, 301. When the pliers are stored, the pivot point is within the handles which touch each other. Thus, the pliers cannot pivot and the handles are precluded from opening. While an ancillary tool is in use, it would be possible to impart a force against the pliers head so that it would tend to move out of the handles into the extended position. Allow such an action to happen and let tang 107 move towards the "open" end of the handle. It will stop moving at the point when the angle of the slot changes, unless the handle is allowed to open. When an ancillary tool is in use, the user will grip both handles in the palm of the hand, keeping the tool closed, and keeping the head from extending.

Figure 18:
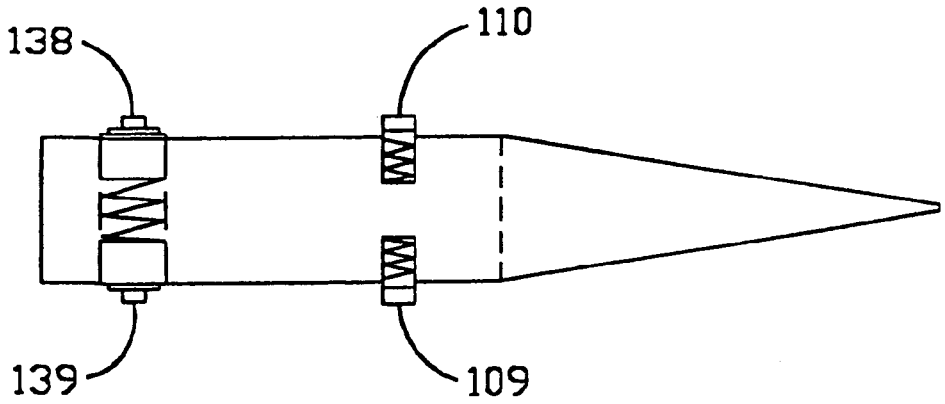
Figure 19:
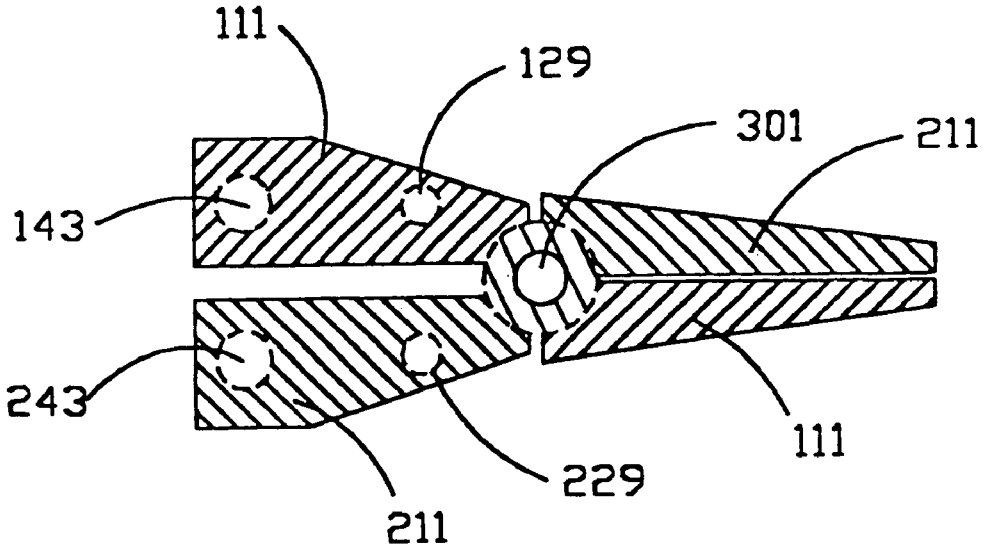

Several different embodiments of the instant invention are available. The most obvious being illustrated in FIGS. 17 through 19, where the locking tangs, 138 and 139 have been moved to the rear-most position, and the guide tangs, 110 and 109 have been moved to the front-most position on the pliers head. Each of these tangs slide in the slot; however, the associated locking apertures, 141 and 241 have been moved to the point where the slot changes its relative angle. In a similar manner apertures, 143, 142 (not shown) 243, 242 (not shown), 129, 128 (not shown), 229, and 228 (not shown) must be provided in the pliers head. It would be possible to reduce the number of locking tangs to one, as previously described in the preferred embodiment.

The tool can be further modified by providing a rearmost locking aperture in the slot. This would provide a positive lock for the tool when in the closed position. This alternative is not shown and would not allow the user to "flip" the tool open by imparting an inertial force to the tool.

Figure 7:
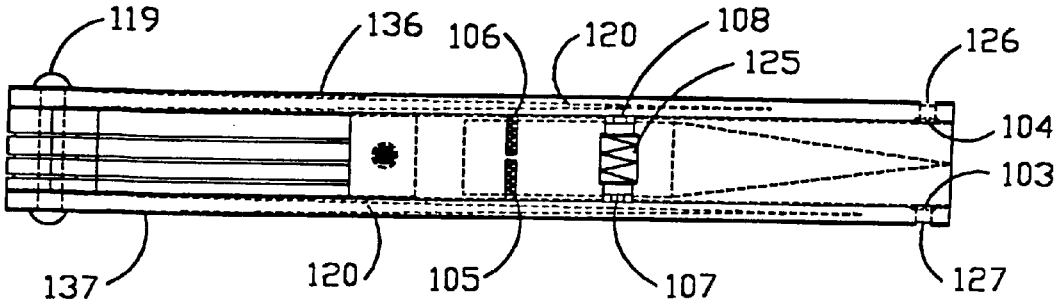
Figure 8:
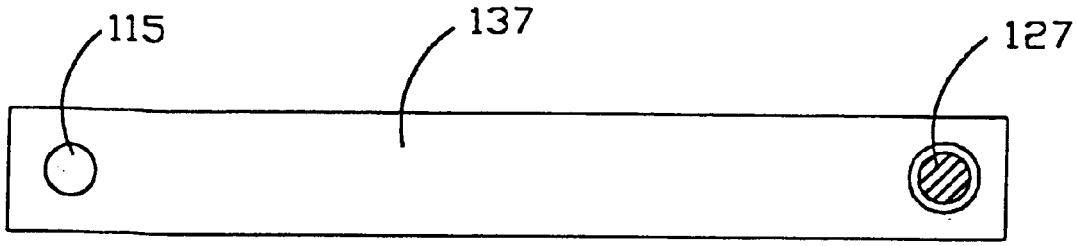

A further embodiment which is most useful as an ancillary to the preferred embodiment is shown in FIGS. 7 and 8. This embodiment adds an extra cover, 136 and 137, to the first handle and similarly covers, 236 and 237, to the second handle. These covers hide additional blades, 120 and 220 which can be much longer than ancillary blades 119 and 219. There can be up to four such blades which could take the form of a simple long knife, long screwdriver, etc. Alternately the cover could be set up to provide only one such blade. In order to gain access to the latching tang (or tangs) to close the extended pliers head, access ports 126, 127, 226 (not shown) and 227 (not shown) are provided.

Figure 9:
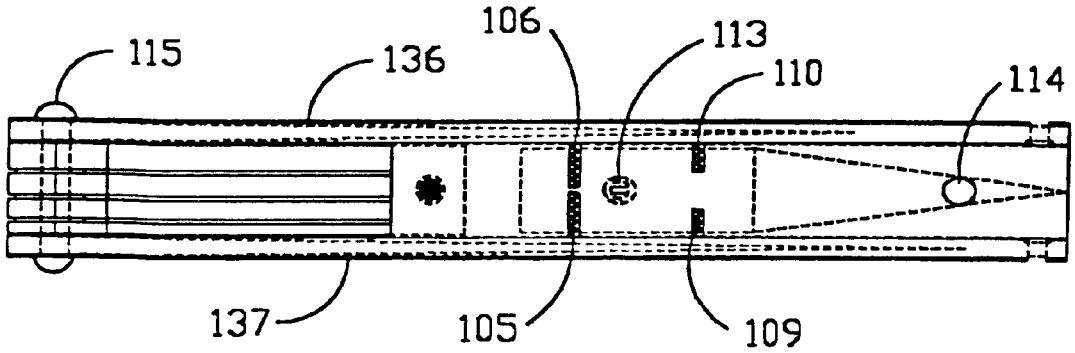

Another embodiment is shown in FIGS. 10 through 13. (A further sub-embodiment utilizing the ancillary blade within an outer cover as described in the paragraph immediately preceding this paragraph is shown in FIG. 9. Note no cover access holes are required.) This embodiment uses a center or plate locking tang, 113, in first handle and 213 in the second handle. The same sidewall slots used in the first embodiment, but without locking apertures, are employed. Guide tangs 105, 109, 205, 209, 106 (not shown), 110 (not shown), 206 (not shown), and 210 (not shown) are held within their respective apertures, 121, 129, 221, 229, 122 (not shown), 128 (not shown), 222 (not shown) and 228 (not shown) in the pliers head. The guide tangs slide within the sidewall slots, keep the pliers head within the handles (like in the preferred embodiment), and bear the load between the pliers and the handles when the pliers are being used.

The plate locking tangs, 113 and 213, will be only described for the first handle as the action of the two tangs is identical. In fact, one of the two tangs could be left out of the device, and it is believed that such a manufacturing choice is covered by this disclosure. When the pliers head is extended, plate locking tang 113, slides along the inside of the channel section (plate) of the second handle until it pops through the locking aperture 114 which is near the 'extended' end is of the handle in the channel section (plate). The plate locking tang, 113, is similar to the guide/locking tang assembly, 303 except that only one half of the assembly is used—namely parts 125 and 133 or 134. The plate locking tang fits in aperture 123 in the pliers head. The spring loaded locking tang is held in place by the U-handles and the guide tangs.

The use of the tool is quite simple and operated like the preferred embodiment. When the 20 tool is stored (pliers head retracted) the tool appears very much like FIG. 10, except that no ancillary blades are extended. To extend the pliers head, the user (operator) simply holds one of the handles tightly between the fingers and the base of the thumb of one hand and flips the hand outwards. This action imparts momentum to the pliers head causing it to move forward out of the handle (held in the hand) while taking with it the other handle. The user then flips the wrist the in other direction which imparts momentum to the remaining handle which flies away from the pliers head leaving both handles extended away from the pliers head and ready for use. Alternately, the user can use the other hand to physically open the two handles and slide the respective head out from its handle. Transfer of operating forces is the same as for the preferred embodiment.

To close the tool, the user must push on each of the plate locking tangs, 113 or 213, pressing against spring 135 or 235 to move the locking tang out of their associated locking aperture 114/214. At the same time, the pliers head is pushed by the other hand so that it retracts into the handles.

The tool can be further modified by providing a second locking aperture in the U-handle so that the pliers head is locked closed when retracted. This alternative is not shown and would not allow the user to "flip" the tool open.

To replace the jaws, the user would first extend the jaws. The user would then press on 15 the locking tangs holding the pliers jaw in one handle with the thumb and forefinger of one hand, while pulling on the jaws with the other hand. This would pull the jaws forward until the second set of tangs reaches the end of the slot. Now the user presses the rearward set of tangs and pulls the jaws clear of the handles. The operation would be repeated with the other handle. The other set of jaws would be placed in its respective handle by reversing the process just described.

The ancillary blade-type tools operate in an identical manner as previously described for the preferred embodiment. For the embodiment where an extra long blade is hidden in a side cover, the access holes are not needed because the locking tang is located in the channel section (or plate) of the handle and would not be covered by the side cover.

It will be understood that the above description illustrates the preferred and best mode embodiment and reasonable alternative embodiments of the instant invention. The invention is not limited to the present forms illustrated, and the final form will be based on reasonable manufacturing decisions. For example, the manufacture may choose to use all spring loaded locking/guide tangs as described while providing a model that does not have replaceable jaws. The manufacturer may choose to use only one locking tang. Such modifications are foreseen and form a part of the invention. Thus, these and other modifications may be made in the design and arrangement of the elements while within the scope of the disclosure.

What is claimed is:

1. A multifunction tool, comprising:

a pair of handles, each handle having two side walls and a plate connecting the two side walls;

a pair of jaws coupled to the handles, each jaw having at least one pin extending therefrom;

a slot disposed in at least one side wall, the slot configured to receive the pin, whereby the jaws are slidably coupled to the handles, such that the jaws have a retracted position and an extended position; and at least one ancillary tool coupled to one of the handles.

2. The multifunction tool of claim 1, further comprising:

a spring coupled to one of the handles, the spring configured to engage the ancillary tool.

3. The multifunction tool of claim 2, wherein the spring biases the ancillary tool in the open position.

4. The multifunction tool of claim 3, wherein the spring biases the ancillary tool in the closed position.

5. The multifunction tool of claim 1, wherein the jaws are configured to be removed from the handles.

6. The multifunction tool of claim 5, wherein the jaws are removed from the handles by depressing the at least one pin.

7. The multifunction tool of claim 1, wherein the at least one pin is spring-biased, and further comprising:

a locking aperture disposed on one end of the slot, wherein the spring-biased pin extends through the locking aperture thereby locking the jaws into the extended position.

8. The multifunction tool of claim 1, wherein the handles are parallel when the jaws are in the retracted position and the handles are disposed at an angle from one another when the jaws are in the extended position regardless of whether the jaws are in an open position or a closed position.

9. The multifunction tool of claim 1, wherein at least one of the handles further comprises a cover disposed over the plate and a tool pivotally coupled to the handle between the cover and the plate.

10. The multifunction tool of claim 1, wherein each side wall includes one of the slots.

11. The multifunction tool of claim 1, wherein each jaw includes one of the pins.

12. A multifunction tool, comprising:

a pair of handles, each handle having at least one non-linear slot;

a pair of jaws coupled to the handles, at least one of the jaws having a pin extending through the slot; and at least one ancillary tool pivotally coupled to at least one of the handles.

13. The multifunction tool of claim 12, wherein each jaw includes two pins extending through the slot such that each jaw is prevented from pivoting with respect to the handle to which it is secured.

14. The multifunction tool of claim 12, further comprising:

a spring coupled to one of the handles, the spring configured to engage the ancillary tool.

15. The multifunction tool of claim 14, wherein the spring biases the ancillary tool in the open position.

16. The multifunction tool of claim 14, wherein the spring biases the ancillary tool in the closed position.

17. The multifunction tool of claim 12, wherein the jaws are configured to be removed from the handles.

18. The multifunction tool of claim 17, wherein the pin is spring-biased, and further comprising:

a locking aperture disposed on one end of the slot, wherein the spring-biased pin extends through the locking aperture thereby locking the jaws into an extended position.

19. The multifunction tool of claim 18 wherein each jaw includes one of the spring-biased pins.

20. The multifunction tool of claim 12, wherein the handles are parallel when the jaws are in a retracted position and the handles are separated from one another when the jaws are in an extended position regardless of whether the jaws are in an open position or a closed position.

21. The multifunction tool of claim 12, wherein at least one of the handles further comprises a cover disposed over the plate and a tool pivotally coupled to the handle between the cover and the plate.

22. The multifunction tool of claim 12, wherein each side wall includes one of the slots.

* * * * *